US006505617B1

(12) United States Patent
Neuman

(10) Patent No.: US 6,505,617 B1
(45) Date of Patent: Jan. 14, 2003

(54) WINDMILL PITCHING MACHINE

(75) Inventor: Daniel R. Neuman, Loami, IL (US)

(73) Assignee: Mantiff Inc., Loami, IL (US)

( * ) Notice: Subject to any disclaimer, the term of this patent is extended or adjusted under 35 U.S.C. 154(b) by 0 days.

(21) Appl. No.: 09/891,935

(22) Filed: Jun. 26, 2001

Related U.S. Application Data

(60) Provisional application No. 60/214,588, filed on Jun. 27, 2000.

(51) Int. Cl.[7] ..... F41B 3/03
(52) U.S. Cl. ..... 124/7; 124/36
(58) Field of Search ..... 124/6, 7, 16, 36, 124/41.1, 81

(56) References Cited

U.S. PATENT DOCUMENTS 3,410,258 A * 11/1968 Lee ..... 124/6
3,572,308 A 3/1971 Smith ..... 124/7
3,640,262 A 2/1972 Hunsicker ..... 124/7
4,458,656 A * 7/1984 Giovagnoli ..... 124/7
4,471,746 A * 9/1984 Ando ..... 124/6
4,524,749 A * 6/1985 Giovagnoli ..... 124/7
4,995,371 A 2/1991 Kuizinas ..... 124/7
5,121,735 A 6/1992 Hancock ..... 124/7
5,562,282 A 10/1996 Stevenson ..... 273/26 D

* cited by examiner

*Primary Examiner*—John A. Ricci
(74) *Attorney, Agent, or Firm*—Philip L. Bateman

(57) ABSTRACT

A ball pitching machine of the windmill type simulates the pitching motion of a human pitcher. The machine includes: (a) a rotating plate which rotates vertically 360° at a constant speed about an axis; (b) a pitching arm having a ball holder at a distal end and being pivotably connected to the rotating plate at a proximate end, the pitching arm adapted to rotate vertically about an arc of between about 100 and 300° at a high speed and to rotate about the remaining arc at the speed of the rotating plate; and (c) a flip lever pivotably connected to the pitching arm.

12 Claims, 6 Drawing Sheets

WINDMILL PITCHING MACHINE

CROSS-REFERENCE TO RELATED APPLICATION

This application claims the benefit of U.S. Provisional Application Ser. No. 60/214,588, filed Jun. 27, 2000.

FIELD OF THE INVENTION

This invention relates to ball pitching machines. More particularly, this invention relates to windmill pitching machines especially adapted for simulating the pitching motion of a human pitcher.

BACKGROUND OF THE INVENTION

Baseball is one of the most popular games in the United States, Japan, and many Caribbean countries. The game is so popular in the United States that it is known as "the national pastime." The game features a player with a bat attempting to hit a ball pitched by an opposing player. To hit the pitched ball, the batter must swing the bat at exactly the right place at exactly the right time. Several variations of baseball are widely played. In the form most widely played by men and boys, the pitcher throws a hard ball having a circumference of about nine inches overhanded. This form of baseball is sometimes known as "hardball." In the form most widely played by women and girls, the pitcher throws a ball having a circumference of about twelve inches underhanded. This form of baseball is commonly known as "softball." Older men and women often play a form of softball commonly known as "slow pitch softball" which is similar to conventional softball, except the pitcher throws the ball at a slower speed and with a much greater arc. The term "baseball" is used herein to include all variations of the game and, as the context requires, to also refer to all types of balls used to play the game. Due to the tremendous growth of competitive sports for girls, softball is growing rapidly in popularity in the United States. Most high schools now have girls softball teams.

Techniques have been developed that enable a top men's softball pitcher to throw the ball at speeds in excess of about ninety miles per hour. The top high school girl pitchers are able to throw the ball at speeds in excess of about fifty miles per hour. The pitching motion features a windmill motion with the arm, a strong push off the pitcher's mound with the lower body, and a snap of the wrist at release. The snap of the wrist enables the ball to be thrown at a velocity substantially greater than that generated by the motion of the arm and the rest of the body. The ball reaches the batter so quickly that a batter must begin to swing the bat as the pitcher begins the pitching motion. The batter must make a split-second decision after the ball is released to continue the swing or to stop it.

A variety of machines have been developed to pitch baseballs to batters for practice. A first class of machines features rapidly spinning wheels that fling the baseball to the batter. These machines are unsatisfactory because they do not simulate the motion of an actual pitcher. In particular, the batter's sense of timing is not improved because he or she cannot coordinate the beginning of the swing with the motion of an arm.

A second class of pitching machines feature reciprocating pitching arms. Examples of such machines are disclosed in Smith, U.S. Pat. No. 3,572,308, issued Mar. 23, 1971; Kuizinas, U.S. Pat. No. 4,995,371, issued Feb. 26, 1991; and Stevenson, U.S. Pat. No. 5,562,282, issued Oct. 8, 1996. The pitching arms of these machines travel through an arc of only about 90° before releasing the ball and rely solely upon the speed attained by the arm during this arc to provide velocity to the pitched ball. In other words, the speed of the machine's pitching arm is much faster than the speed of a real person's pitching arm. As a result, the batter cannot coordinate the beginning of the swing with the motion of the arm.

A third class of pitching machines feature windmill pitching arms that rotate 360°. Examples of such machines are disclosed in Hunsicker, U.S. Pat. No. 3,640,262, issued Feb. 8, 1972; and Hancock, U.S. Pat. No. 5,121,735, issued Jun. 16, 1992. Although these pitching arms rotate 360° during the pitching cycle, the arc from the point where the ball is picked up to the point where the ball is released is still only about 90°. Furthermore, these machines rely solely upon the speed attained by the arm during this arc to provide velocity to the pitched ball. As a result, the batter cannot coordinate the beginning of the swing with the motion of the arm.

Accordingly, it can be seen that a demand exists for a windmill pitching machine that more closely simulates the pitching motion and release of a human pitcher. More particularly, a machine is needed that provides a pitching motion with a wide arc ending in a release that increases the velocity of the ball.

SUMMARY OF THE INVENTION

The general object of this invention is to provide an improved pitching machine that simulates the pitching motion and release of a human pitcher. A more particular object is to provide a windmill pitching machine that closely simulates the underhand pitching motion of a fast-pitch softball pitcher by providing a pitching arm motion with a wide arc ending in a release that increases the velocity of the ball.

I have invented an improved ball pitching machine of the windmill type. The machine comprises: (a) a frame having a ball magazine, a ball cradle, and a pitching arm pause stop member; (b) a rotating plate mounted to the frame, the plate having a pitching arm final stop member and being adapted to rotate vertically 360° at a constant speed about an axis; (c) a pitching arm having a ball holder at a distal end and being pivotably connected to the rotating plate at a proximate end, the pitching arm adapted to rotate vertically about an arc of between about 100 and 300° from the pause stop member to the final stop member at a high speed, to rotate about the remaining arc and to pick up a ball from the ball cradle at the speed of the rotating plate, and to pause at the pause stop member; (d) a flip lever pivotably connected to the pitching arm, one end of the lever adapted to rest against a ball in the ball holder and the other end of the lever adapted to contact the final stop member; (e) a spring connected between the rotating plate and the pitching arm that biases the pitching arm in a direction toward the final stop member; and (f) a means for rotating the rotating plate.

The rotation of the pitching arm through a wide arc simulates the motion of a human pitcher's arm and the action of the flip lever simulates the motion of the pitcher's wrist snap release by increasing the velocity of the ball. The underhand embodiment of the machine especially simulates the motion of a fast pitch softball pitcher's arm. The machine enables the batter to coordinate the beginning of the swing with the motion of the pitching arm.

DETAILED DESCRIPTION OF THE INVENTION

Figure 1:
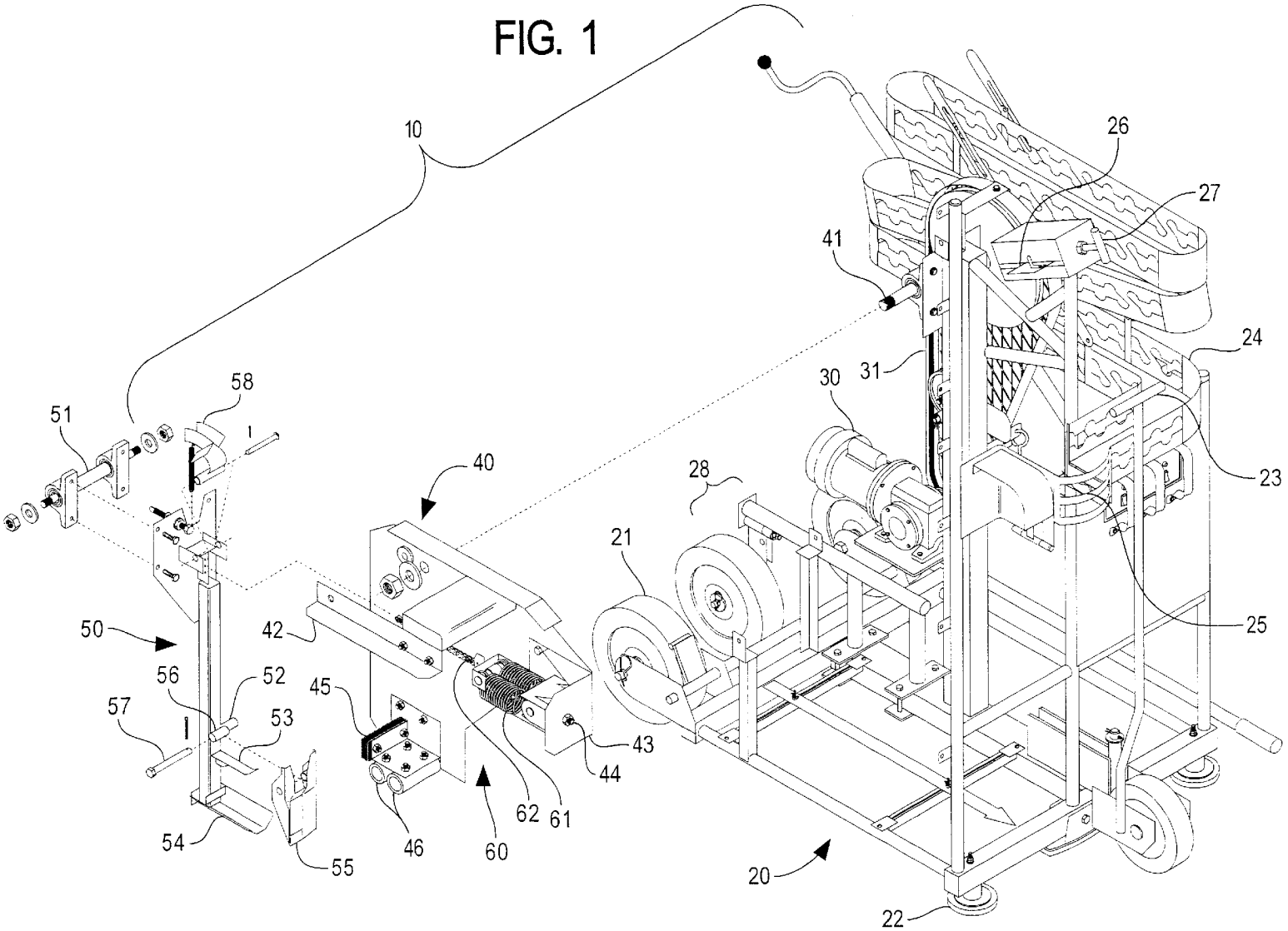
FIG. 1 is an exploded perspective view of a preferred embodiment of the underhand embodiment of the pitching machine of this invention omitting safety screens for clarity.

This invention is best understood by reference to the drawings. A preferred embodiment of the underhand pitching machine 10 of this invention contains a frame 20 to which the other components are attached. The frame can be secured at a single location or, as shown in the preferred embodiment, it can be adapted with wheels 21 or the like so that it can be moved from location to location. If the frame rests entirely on wheels, brakes and/or stands 22 are used to prevent movement of the machine during pitching. A handle 23 enables the machine to be easily moved across horizontal surfaces. The frame contains a softball magazine 24 consisting of an inclined ramp to hold a quantity of softballs. The softball magazine feeds a upwardly hinging softball cradle 25 which holds a softball in a position where it can be picked up by a pitching arm, as discussed below. The frame also contains a pitching arm pause stop member 26 consisting of an angled plate which can be moved upwardly and downwardly through a limited range by turning knob 27. The function of the pause stop member is described below. The frame further contains a walking stabilizer assembly 28 which is described below.

Mounted to the frame is an electric motor 30 with a drive shaft. A drive pulley (hidden from view) is mounted onto the drive shaft. The drive pulley turns a driven pulley by means of a drive belt 31. A spring-loaded idler pulley (partially hidden from view) maintains tension on the drive belt. The driven pulley preferably rotates at a speed of about seven revolutions per minute. While a drive assembly comprising pulley and one or more drive belts is preferred, other drive assemblies such as chains, sprockets, gears, or the like are also suitable. The motor is controlled by an on-off switch (not shown) and receives power from an AC outlet.

A rotating plate 40 is mounted onto the driven pulley by means of shaft 41. The rotating plate rotates with the driven pulley at a constant speed. The rotating plate contains a pitching arm bracket 42 to which a pitching arm shaft, described below, is attached. The rotating plate also contains a spring bracket 43 to which a set of springs, described below, is attached. The tension on the springs at rest is adjusted by turning tension screw 44. The rotating plate further contains a pitching arm final stop member 45 and rubber cushioning tubes 46, which are described below.

A pitching arm 50 is pivotably mounted to the rotating plate by perpendicular pitching arm shaft 51, one end of which extends through the rotating plate and the other end of which extends through the pitching arm bracket. It can be seen that the axis of rotation of the pitching arm is offset from the axis of rotation of the rotating plate. The pitching arm contains an engaging bar 52 which extends perpendicularly and whose purpose is to contact the pause stop member of the frame during the pitching cycle. The pitching arm also contains a ball holder having an upper member 53 and a lower member 54. Attached to the distal end of the pitching arm is flip lever 55. The flip lever is pivotably mounted by means of a hinge 56 and hinge pin 57. The flip lever contains a cut-out which allows it to pass over the upper member of the ball holder without interference. A chain guide 58 is mounted over the pitching arm shaft. The chain guide is rotated to vary its radius which, in turn, varies the leverage and tension on the springs during the pitching motion.

A spring assembly 60 is attached at one end to the pitching arm and at the other end to the rotating plate. The spring assembly comprises a set of two springs 61 mounted between two brackets and a chain 62 mounted between a bracket and the pitching arm. As previously described, relatively minor adjustments to the tension on the springs at rest are made by turning tension screw 44. Major adjustments to the leverage and tension on the springs during the pitching motion are made by rotating the chain guide. The springs pull, or bias, the pitching arm toward the final stop member. As discussed below, the force of the springs provides the energy that moves the pitching arm between the pause stop member and the final stop member. A preferred spring is Model No. 12336 sold by Century Spring Company of Los Angeles, Calif. This zinc-coated steel spring has an outside diameter of two inches, a length inside hooks of 7.5 inches, a wire diameter of 0.20 inches, and a suggested maximum loads of 122 pounds. A pair of these springs enable the machine to pitch a ball at a speed of about forty to sixty miles per hour.

Figure 3:
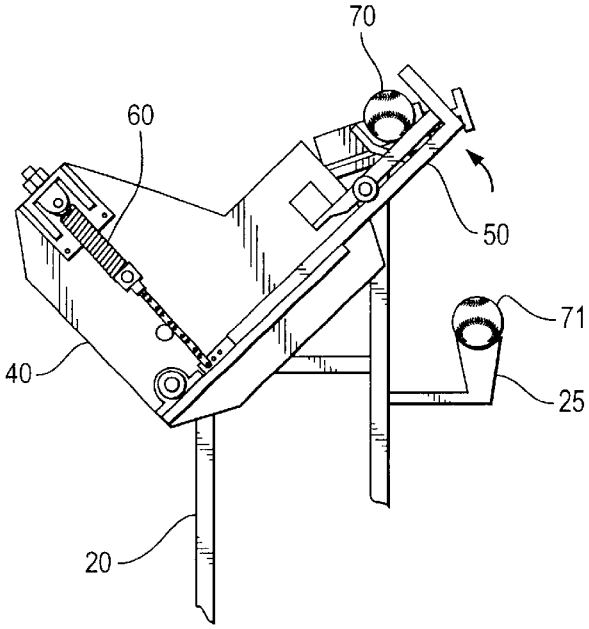
FIGS. 3, 4, and 5 are similar to FIG. 2, except showing, respectively, a second, third, and fourth stage of the pitching cycle.
Figure 2:
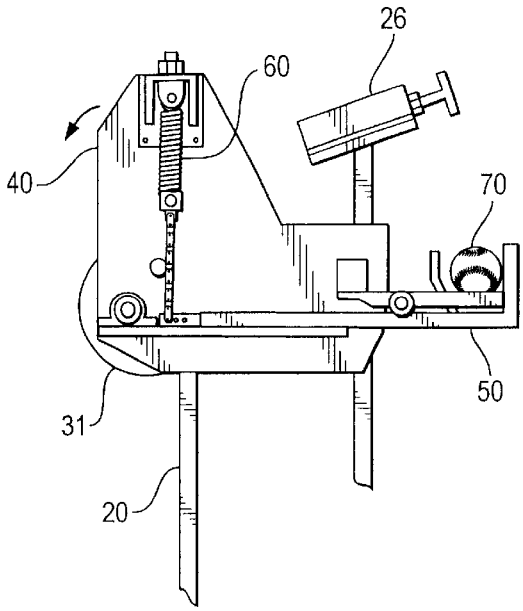
FIG. 2 is an elevational view of a portion thereof at a first stage of the pitching cycle.

The operation of the pitching machine can now be considered. Turning to FIG. 2, the pitching machine is shown at the stage where the pitching arm is picking up a softball 70 from the softball cradle. The arrow shows that the rotating plate and pitching arm are moving in the counter-clockwise direction. Turning now to FIG. 3, the pitching arm has been stopped at the pause stop member of the frame. The rotating plate continues to rotate. Another softball 71 has rolled from the magazine onto the cradle.

Figure 4:
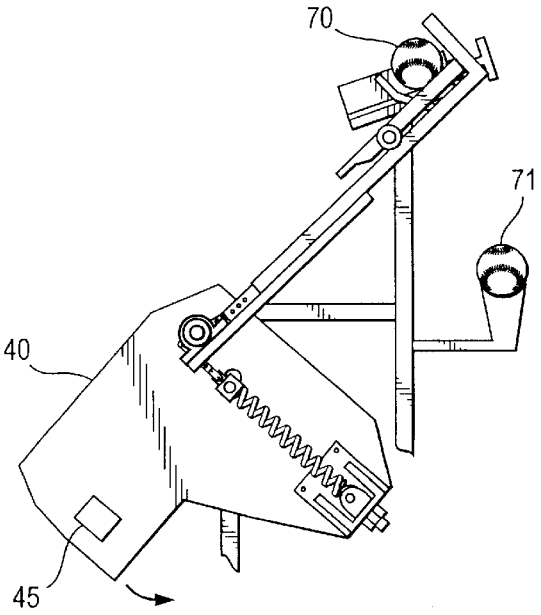

In FIG. 4, it can be seen that the rotating plate has continued to rotate while the pitching arm is still restrained at the pause stop member. Because of the offset of the pitching arm axis from the rotating plate axis, the distance between the pitching arm axis and the pause stop member increases as rotation continues. This, in turn, causes the engaging bar of the pitching arm to move downward against and along the bottom surface of the pause stop member. Meanwhile, the tension on the springs continues to increase.

Figure 5:
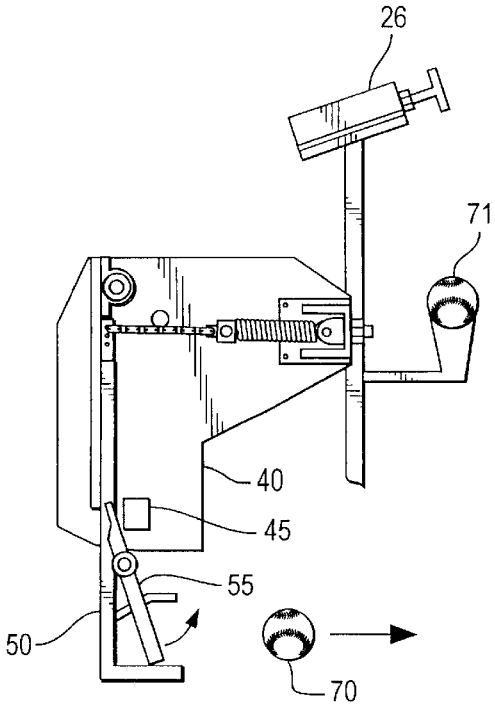

In FIG. 5, the pitching arm has finally slid off the pause stop member. The force of the springs pulls the pitching arm through an arc of between about 100 and 300°, preferably about 200 to 250°, and most preferably about 225°, from the pause stop member to the final stop member at a high speed. An arc of about 225° is most preferred because it corresponds to the arc of a softball pitcher's arm. The flip lever and the pitching arm contact the final stop member at the same time. The flip lever flips upward and bounces off the rubber cushioning tubes. The combination of the speed of the pitching arm and the action of the flip lever propels the softball toward the target at a high speed. Speeds of about forty to sixty miles per hour are easily generated. The motion of the pitching arm closely simulates the motion of a fast pitch softball pitcher's arm, both in terms of arc and speed. This motion enables a batter to coordinate the beginning of the swing with the motion of the machine's pitching arm.

The speed of the pitched ball is determined primarily by the spring force. As previously discussed, this force is adjusted, for a given set of springs, by changing the tension on the springs by rotating the chain guide and/or by turning the tension screw. The height of the pitch (the launch angle) is determined primarily by the location of the pause stop member. The height of the pitch is lowered by moving the pause stop member upward so the pitching arm releases from the pause stop member at an earlier point. The height of the pitch is raised by moving the pause stop member downward.

Although the above described embodiment of the pitching machine is adapted for pitching softballs underhanded at a relatively high speed, it is understood that any similar sized balls (for example, baseballs and tennis balls) can also be pitched by the machine. It is also understood that the pitching machine can pitch softballs underhanded at a relatively low speed and with a relatively high arc by reducing the number and/or force of the springs, by shortening the pitching arm, and by changing the launch angle of the pitch.

Figure 6:
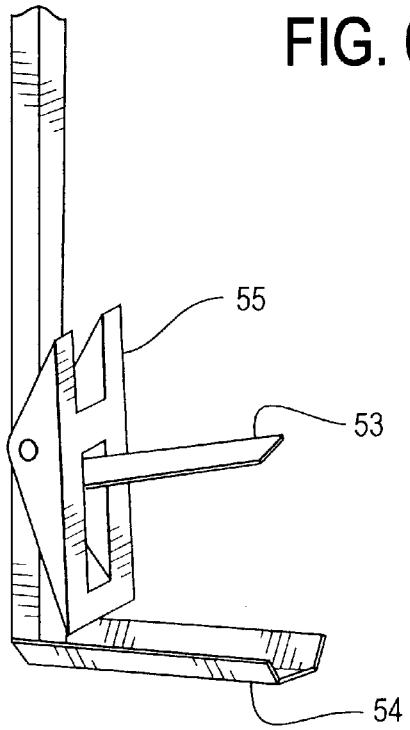
FIG. 6 is a detailed perspective view of a flip lever.
Figure 7:
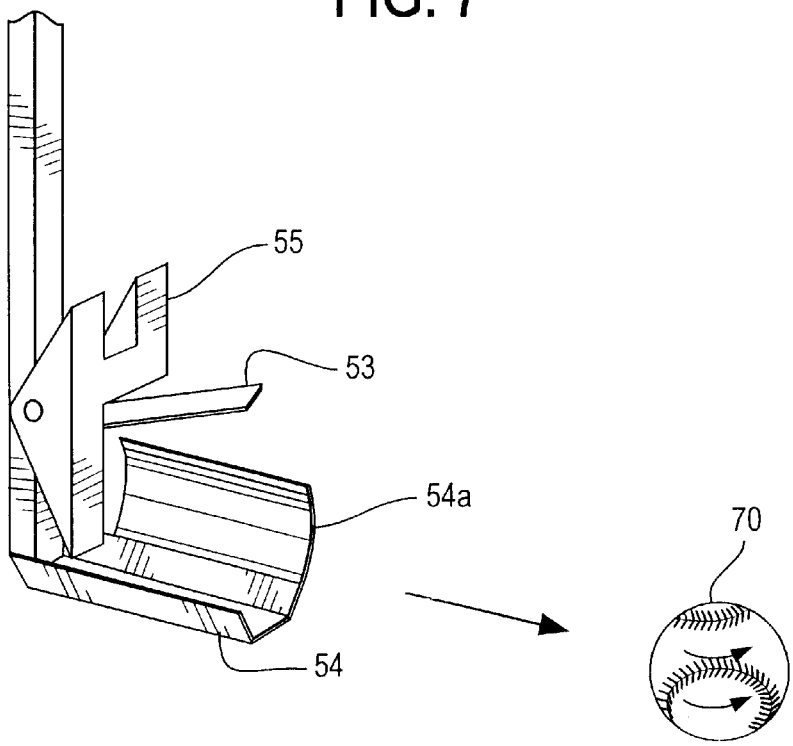
FIG. 7 is a detailed perspective view of an alternative flip lever.

The preferred embodiments of the pitching machine pitch balls with little or no side rotation. However, small changes to the machine can cause the balls to be pitched with sufficient side rotation that they curve in flight in the same manner as curve balls pitched by human pitchers. One way of creating sufficient side rotation is shown in FIG. 7. Contrasting the FIG. 7 embodiment with the FIG. 6 embodiment, a portion of the flip lever is removed and one side of the lower member of the ball holder is extended upward to create a guide 54*a*. The combination of the asymmetrical flip lever and guide causes a pitched ball to rotate in the direction shown with sufficient speed that it curves in flight. Another way of creating side rotation is shown in the embodiment of the overhand machine discussed below.

The pitching arm and the final stop member are located off center in the machine. As a result, the force applied by the pitching arm to the final stop member creates a sideways force on the machine. Depending on the amount of the sideways force, the weight of the machine, the wheels, and the surface upon which the machine rests, this sideways force can cause the entire machine to move slightly in a twisting motion. Even a relatively small change in position of the pitching machine creates a significant change in the location of the pitched ball. If twisting is a potential problem, one solution is to restrain the machine at the desired location with wheel chocks, blocks, stakes, or the like.

Figure 8:
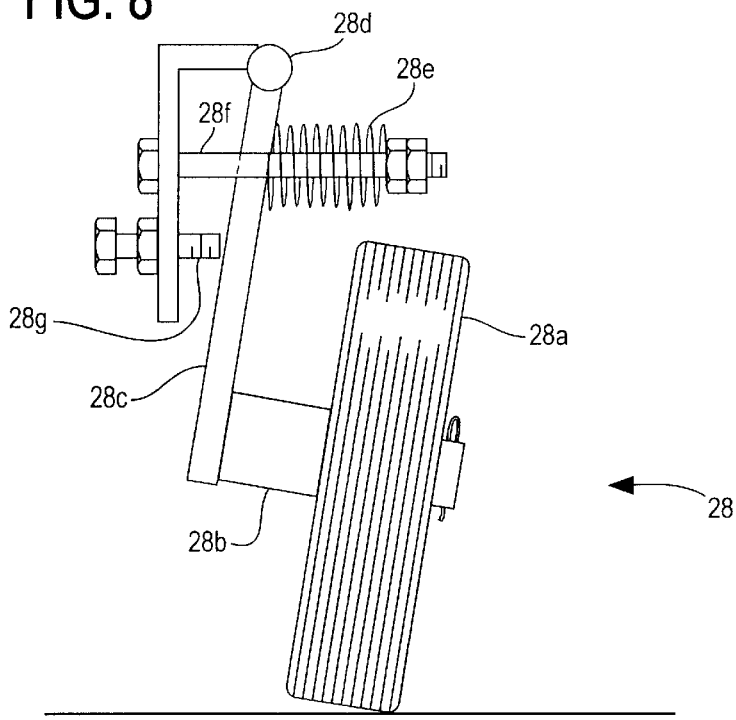
FIG. 8 is a rear elevation view of a walking stabilizer.
Figure 9:
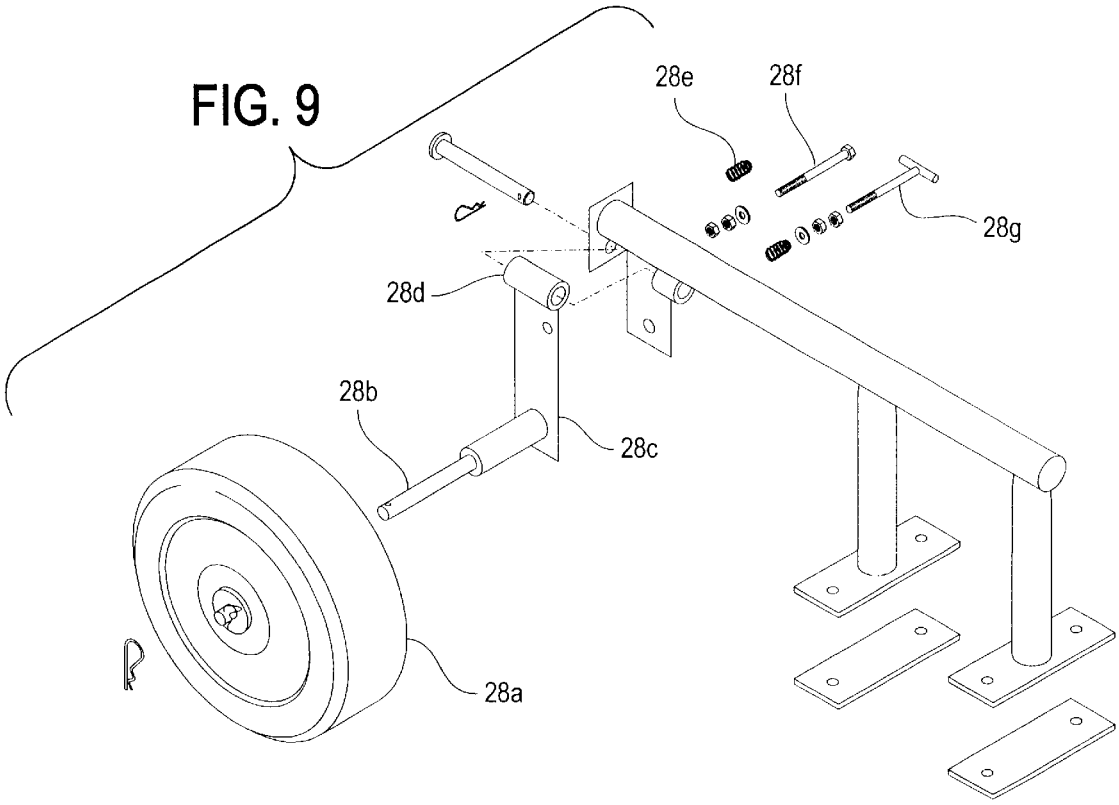
FIG. 9 is an exploded perspective view thereof.

Another solution to twisting is to add a stabilizer to the machine. An example of a walking stabilizer 28 is shown in FIGS. 8 and 9. The walking stabilizer includes a wheel 28*a* whose axle 28*b* is connected at a right angle to a support arm 28*c*. The wheel is pneumatic, semi-pneumatic, or solid. The support arm pivots about a hinge 28*d* so that the wheel can move with a pendulum-like motion. A helical spring 28*e* encircles a rod 28*f* and is compressed between the support arm and the head of the rod. An adjustable rod 28*g* limits the inward movement of the support arm. When the pitching arm contacts the final stop member and a sideways force is generated, the force is resisted by the action of the walking stabilizer.

Figure 10:
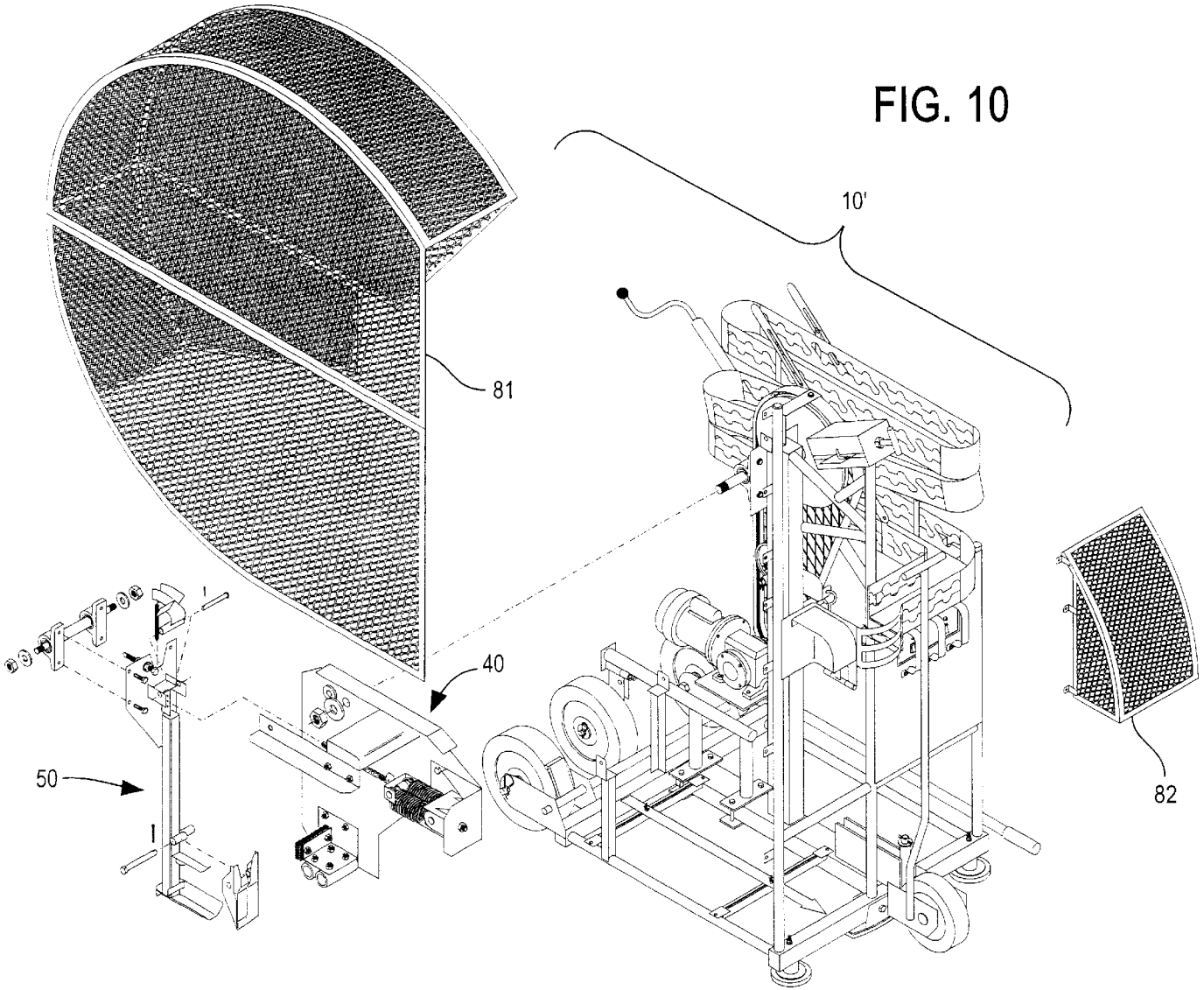
FIG. 10 is similar to FIG. 1 except including the safety screens.

Referring now to FIG. 10, the pitching machine preferably includes safety screens 81 and 82 which prevent a user from being injured by the pitching arm.

Figure 11:
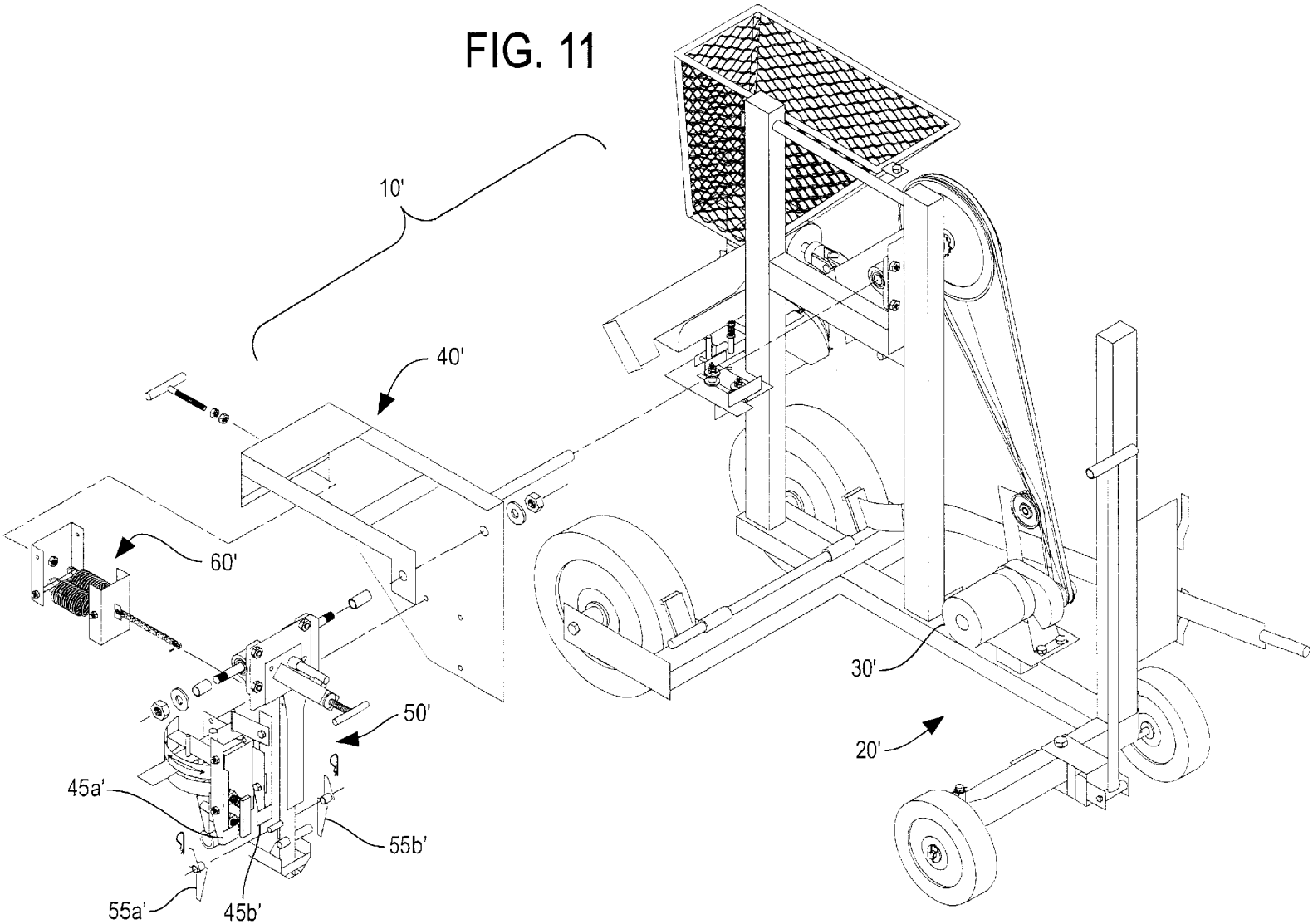
FIG. 11 is an exploded perspective view of a preferred embodiment of the overhand embodiment of the pitching machine of this invention.

The direction of rotation of the pitching arm can easily be reversed to simulate an overhanded throw. A preferred embodiment of an overhand pitching machine 10' is shown in FIG. 11. The overhand machine includes a frame 20', a motor 30', a rotating plate 40', a pitching arm 50', and a spring assembly 60'. This embodiment contains two independent flip levers 55*a*' and 55*b*' and two independent final stop members 45*a*' and 45*b*'. When the final stop members are adjusted so both flip levers make contact at the same time, the ball is pitched with little or no side rotation. Conversely, when the independent stop members are adjusted so one of the independent levers makes contact first, side rotation is induced and the pitched ball curves in flight.

I claim:

1. A ball pitching machine comprising:

(a) a frame having a ball magazine, a ball cradle, and a pitching arm pause stop member;

(b) a rotating plate mounted to the frame, the plate having a pitching arm final stop member and being adapted to rotate vertically 360° at a constant speed about an axis;

(c) a pitching arm having a ball holder at a distal end and being pivotably connected to the rotating plate at a proximate end, the pitching arm adapted to rotate vertically about an arc of between about 100 and 300° from the pause stop member to the final stop member at a high speed, to rotate about the remaining arc and to pick up a ball from the ball cradle at the speed of the rotating plate, and to pause at the pause stop member;

(d) a flip lever pivotably connected to the pitching arm, one end of the lever adapted to rest against a ball in the ball holder and the other end of the lever adapted to contact the final stop member;

(e) a means for biasing the pitching arm in a direction toward the final stop member; and (f) a means for rotating the rotating plate;

such that the high speed rotation of the pitching arm and the action of the flip lever simulates the pitching motion of a human pitcher.

2. The pitching machine of claim 1 wherein the means for biasing the pitching arm comprises a spring connected between the rotating plate and the pitching arm and wherein the means for rotating the rotating the rotating plate comprises an electric motor and a drive assembly.

3. The pitching machine of claim 2 wherein the pitching arm rotates about an arc of between about 200 and 250° from the pause stop member to the final stop member at a high speed.

4. The pitching machine of claim 3 wherein the flip lever and/or the final stop member are asymmetrical so that side spin is induced in the pitched ball when the flip lever contacts the final stop member.

5. The pitching machine of claim 4 wherein the direction of rotation of the rotating plate and pitching arm is underhand.

6. The pitching machine of claim 4 wherein the direction of rotation of the rotating plate and pitching arm is overhand.

7. A softball pitching machine of the windmill type, the pitching machine comprising:

(a) a frame having a softball magazine, a softball cradle, and a pitching arm pause stop member;

(b) a rotating plate mounted to the frame, the plate having a pitching arm final stop member and being adapted to rotate vertically 360° at a constant speed about an axis;

(c) a pitching arm having a ball holder at a distal end and being pivotably connected to the rotating plate at a proximate end, the pitching arm adapted to rotate vertically about an arc of between about 100 and 300° from the pause stop member to the final stop member at a high speed, to rotate about the remaining arc and to pick up a softball from the softball cradle at the speed of the rotating plate, and to pause at the pause stop member;

(d) a flip lever pivotably connected to the pitching arm, one end of the lever adapted to rest against a softball in the ball holder and the other end of the lever adapted to contact the final stop member;

(e) a means for biasing the pitching arm in a direction toward the final stop member; and (f) a means for rotating the rotating plate;

such that the high speed rotation of the pitching arm and the action of the flip lever simulates the pitching motion of a fast pitch softball pitcher.

8. The pitching machine of claim 7 wherein the means for biasing the pitching arm comprises a spring connected between the rotating plate and the pitching arm and wherein the means for rotating the rotating the rotating plate comprises an electric motor and a drive assembly.

9. The pitching machine of claim 8 wherein the pitching arm rotates about an arc of between about 200 and 250° from the pause stop member to the final stop member at a high speed.

10. The pitching machine of claim 9 wherein the flip lever and/or the final stop member are asymmetrical so that side spin is induced in the pitched ball when the flip lever contacts the final stop member.

11. The pitching machine of claim 10 wherein the direction of rotation of the rotating plate and pitching arm is underhand.

12. The pitching machine of claim 10 wherein the direction of rotation of the rotating plate and pitching arm is overhand.

* * * * *